US005538152A

United States Patent [19]

Fontana

[11] Patent Number: 5,538,152

[45] Date of Patent: Jul. 23, 1996

[54] STABILIZING COMPOSITION FOR INORGANIC PEROXIDE SOLUTIONS

[75] Inventor: Costante Fontana, I-Guissano/Milano, Italy

[73] Assignee: Solvay Interox S.p.A., Rosignano-Solvay/Livorno, Italy

[21] Appl. No.: 211,964

[22] PCT Filed: Oct. 23, 1992

[86] PCT No.: PCT/EP92/02442

§ 371 Date: Jun. 22, 1994

§ 102(e) Date: Jun. 22, 1994

[87] PCT Pub. No.: WO93/08317

PCT Pub. Date: Apr. 29, 1993

[30] Foreign Application Priority Data

Oct. 25, 1991 [IT] Italy ..... MI91A2845

[51] Int. Cl.[6] ..... C09K 13/00; C23F 3/00

[52] U.S. Cl. ..... 216/108; 216/100; 252/79.4; 252/79.1; 134/2; 134/3; 134/41

[58] Field of Search ..... 252/79.2, 79.4, 252/79.1; 106/3; 134/2, 3, 41; 216/100, 102–109

[56] References Cited

U.S. PATENT DOCUMENTS

| | | | |
|---|---|---|---|
| 3,770,530 | 11/1973 | Fujimoto | 252/79.4 X |
| 3,773,577 | 11/1973 | Shibasaki et al. | 252/79.4 X |
| 3,945,865 | 3/1976 | Kamperman | 252/79.4 X |
| 3,948,703 | 4/1976 | Kushibe | 252/79.4 X |
| 4,051,057 | 9/1977 | Ericson et al. | 134/3 X |
| 4,086,176 | 4/1978 | Ericson et al. | 134/3 X |
| 4,459,216 | 7/1984 | Nakazato et al. | 252/79.4 |
| 4,462,861 | 7/1984 | McClean | 156/666 X |
| 4,510,018 | 4/1985 | McGowan . | |
| 4,525,475 | 6/1985 | Thorogood | 514/304 |
| 4,875,972 | 10/1989 | Williams et al. | 252/79.4 X |
| 4,875,973 | 10/1989 | Heikkila et al. | 156/901 X |
| 4,915,781 | 4/1990 | Bohren et al. | 156/664 |
| 5,211,927 | 5/1993 | Itami et al. | 423/272 |
| 5,223,087 | 6/1993 | Itami et al. | 156/656 |

FOREIGN PATENT DOCUMENTS

| | | |
|---|---|---|
| 0353084 | 1/1990 | European Pat. Off. . |
| 844760 | 8/1939 | France . |
| 2513258 | 3/1983 | France . |
| 1190292 | 4/1965 | Germany . |

*Primary Examiner*—Thi Dang
*Attorney, Agent, or Firm*—Spencer & Frank

[57] ABSTRACT

Stabilizing composition for inorganic peroxides and hydrogen peroxide intended for baths for the surface treatment of metal components comprising at least one activating agent selected from derivatives of benzotriazoles of imidazole and of carboxyimidazoles. Process for the treatment of metal surfaces using the composition at acid pH in the presence of inorganic peroxide. Use of the composition for producing a bath for pickling, polishing or burnishing metals.

16 Claims, No Drawings

STABILIZING COMPOSITION FOR INORGANIC PEROXIDE SOLUTIONS

FIELD OF THE INVENTION

The present invention relates to a composition which has high stabilizing properties, more particularly in the case of inorganic peroxides used in the context of industrial applications.

It more particularly relates to a stabilizing composition for inorganic peroxides used in baths for pickling metal surfaces.

TECHNOLOGY REVIEW

As is known, surface treatment of stainless steels currently provides for the removal of oxides by means of a chemical process.

It sometimes happens that this chemical process is preceded by a mechanical action, such as sandblasting or brushing of the steel, which operation is carried out with a view to obtaining an improvement in the surface of the steels so as to reduce the duration of their chemical treatment.

Pickling baths of the type mentioned generally contain nitric/hydrofluoric mixtures or sulphuric/nitric and hydrofluoric acid mixtures, to which have been added process correctors which can be surface-active agents, for improving the wetting characteristics thereof, or inhibitors, for rendering the chemical action uniform.

As the surface treatments for steels currently used are particularly polluting as a result of the presence of nitrogen oxides which are produced during the pickling action or as a result of nitrates present in the waste water, pickling baths have recently been proposed which introduce an alternative solution to the conventional processes.

These baths are usually operated while hot and especially require in the same step an additional mechanical action, the objective of which is to compensate for the absence of disintegrating action due to the absence of nitric acid in these baths.

The additional mechanical action normally provides for the production of turbulence in the pickling solution, whether by stirring the liquid or by blowing air into the baths so as to promote detachment of the oxides from the metal surfaces. The absence of nitric acid in these baths is compensated for by the presence of inorganic peroxides such as hydrogen peroxide.

The presence of inorganic peroxides replaces not only the oxidizing action of nitric acid but it also additionally promotes pickling and passivation of the metal surface.

If the use of these pickling baths which are free of nitric acid makes it possible, on the one hand, to solve the problem of pollution due to the production of nitrogen oxide during the pickling action and the problem brought about by the presence of nitrates in the waste water, it however requires the use of specific equipment which is expensive and which requires periodic maintenance.

Moreover, monitoring of the peroxides present in the baths must normally be carried out using redox measuring instruments which, as is known, are not only very expensive to buy but also have a limited lifetime when they are used for this specific purpose.

Baths containing peroxides additionally have a limited stability, as a result of the presence of metals which catalyze the decomposition of the peroxides.

In order to avoid these disadvantages, and therefore the undesirable decompositions of the peroxides, the dissociation action of the peroxides themselves is currently inhibited, which has the side-effect of reducing the chemical activity of the pickling.

In such a situation, and in order to compensate for the low activity of the pickling baths, it is therefore necessary to operate at temperatures greater than ambient temperatures, while additionally stirring the baths so as to promote detachment of the oxides.

In the light of what has just been explained above, it is clearly understood that if, on the one hand, the baths which are free of nitric acid make it possible for the time being to greatly reduce the degree of pollution, it is necessary, on the other hand, either to operate at temperatures which are generally greater than the usual temperatures or to carry out expensive modifications of the equipment, it being necessary for the latter to be equipped with means for heating and stirring the baths or means for blowing air into the same baths, and consequently to provide for automatic and continuous monitoring of the peroxide contained in the pickling mixture.

Under such operating conditions, baths which are free of nitric acid currently remain little used, as a result of the high cost of the equipment but also of the control problems which it leads to.

SUMMARY OF THE INVENTION

In this situation, the technical subject of the present invention is to overcome the disadvantages explained above which are an integral part of the known technique. In the context of this technical subject, an important objective of the present invention is to produce a composition which has high stabilizing properties, more particularly as regards the inorganic peroxides used in the context of industrial applications, it being necessary for this composition to be able to stabilize the peroxides while preventing undesirable decompositions of these same peroxides in the presence of metals, even in high concentrations, and more specifically in the context of acid pickling processes replacing nitric mixtures.

Taking into consideration this technical subject, another important objective of the present invention is to provide a composition which has high stabilizing properties and which is capable of increasing the oxidizing action of the peroxides, more particularly of hydrogen peroxide in contact with metal surfaces, by means of an oxidation/dissolution action of the oxides which is extremely rapid, even at ambient temperature.

Another important objective of the present invention consists in producing a composition which has high stabilizing properties and which is able to provide a pickling system which would replace the baths based on nitric acid which are currently used, without, however, it being necessary to modify the equipment used and without it being necessary to reduce, at the same temperature, the duration of treatment.

Another objective—and not the least—of the present invention is to provide a composition with stabilizing properties which makes it possible to dispense with heating of the solutions and to dispense with their stirring and with the continuous monitoring of the level of peroxides contained in the baths.

DETAILED DESCRIPTION OF THE INVENTION

This subject and all the other anticipated objectives can be achieved only by a composition possessing high stabilizing properties, more particularly for the inorganic peroxides used in the context of industrial applications, characterized in that it comprises at least one activating agent having cyclic or aromatic amino compounds, imidazole and carboxyimidazole derivatives and aliphatic amines which make it possible to increase the oxidation/dissolution action, at ambient temperature, of the oxides and, at the same time, to slow down the decomposition of the inorganic peroxides in contact with the metal surfaces.

The invention relates to a stabilizing composition for inorganic peroxides, more particularly for hydrogen peroxide, intended for baths for the surface treatment of metal components, according to which it comprises at least one activating agent selected from cyclic or aromatic amino compounds, triazoles, imidazole or carboxyimidazoles or their derivatives, and aliphatic amines. Good results have been obtained with triazoles, imidazole, carboxyimidazoles, their derivatives and mixtures of these compounds.

Other additional characteristics and advantages of the invention will largely emerge from the description of a preferred but not exclusive embodiment of the composition possessing high stabilizing properties, in particular for the inorganic peroxides used in the context of industrial applications.

The term inorganic peroxides is understood to denote hydrogen peroxide, inorganic peracids and their salts, more particularly perboric, perphosphoric and persulphuric acids and their alkali metal or alkaline-earth metal salts, and alkali metal and alkaline-earth metal peroxides such as sodium, calcium and magnesium peroxides. Hydrogen peroxide or inorganic peracids are preferably used. Very good results have-been obtained with hydrogen peroxide.

The term surface treatment of metal components is understood to denote the treatment of metal components using a bath comprising one or a number of acidic compounds and one or a number of oxidizing compounds, especially with a view to pickling them by removing the oxides covering their surface or alternatively to passivating them or to improving the surface finish, more particularly to burnishing themand/or to carrying out a polishing treatment.

According to the invention, the composition is intended to be incorporated in baths for the surface treatment of metal components. It does not itself generally contain peroxide, the latter being added to the treatment bath independently.

As is known, the stabilizing action for peroxides and their ability to accelerate deoxidation depend on the composition of the baths in which the traditional standard nitric/hydrofluoric mixture is replaced, as regards the nitric part, by hydrogen peroxide in the $H_2O_2/HNO_3$ molar proportion of 1/2 to 2/1 but preferably 1/1, while the acid part of the nitric acid is replaced by sulphuric acid in the $HNO_3H_2SO_4$ molar proportion of 1/2 to 2.5/1, but preferably 1/1.3.

The acid part, as regards sulphuric acid, can be entirely or partially replaced by inorganic acids of the phosphoric, sulphamic or other type, insofar as they do not lead to a negative interaction with the stabilizing agent for the hydrogen peroxide or the peroxide.

The hydrofluoric part can, for its part, comprise at least one compound chosen from fluorinated acids or fluorinated salts and the percentage is maintained in the known usual standard values.

The bath thus obtained requires the presence of a stabilizing agent for the peroxide in the proportion of 1/100 to 1/1 but preferably from 1/30 to 1/2, as a function of the peroxide used.

The lifetime of the solutions is comparable with or greater than that of an equivalent traditional bath of the type of those which is usually known.

The stabilizing agent used for the baths of these compositions and which constitutes the subject of the present invention can comprise, in addition to the activating agent, at least one other compound chosen from stabilizing agents, solvent compounds of the stabilizing agent, oxidation catalysts, wetting agents capable of withstanding an acidic oxidizing environment, optionally phosphates or phosphonates as coadjuvants of precipitation and of deactivation of the dissolved metals and, finally, inorganic and/or organic acids as agents for making the product uniform.

According to a variant of the invention, the composition additionally comprises at least one stabilizing agent.

As regards the stabilizing agent in particular, it can contain one or a number of aromatic or cyclic rings and one or a number of aliphatic chains. It can additionally contain at least one group chosen from hydroxyl, carboxyl, sulphonate and phosphate groups. The term sulphonate and phosphate groups is understood to denote here both sulphonic and phosphoric groups and their salts. It can also contain at least one group chosen from esters, ethers, dienes, azoles, mercaptoazoles or combinations of these.

According to the invention, the stabilizing agent can comprise at least one compound selected from mono- or polycyclic alicyclic or aromatic compounds and aliphatic compounds substituted by at least one group chosen from hydroxyl, carboxyl, sulphonate, phosphate, ester, ether, diene, azole and mercaptoazole groups. Good results have been obtained with compounds substituted by sulphonate (or sulphonic) and phosphate (or phosphoric) groups or their mixtures. p-Toluenesulphonic acid is well suited.

In combination with the activating agent, the compositions according to the invention can comprise at least one solvent compound of the stabilizing agent.

The solvent compound, also known as the dissolving part, of the stabilizing agent described above can comprise alcohols, glycols, polyethers, dimethylformamide, N-methylpyrrolidone, ketones, polyglycols, esters, low molecular weight condensates or organic groups characterized by a reasonable solubility in water, which are resistant to an acid environment and which have a good dissolving power for organic compounds used as stabilizing agents and having a zero or virtually zero solubility in water or in inorganic acids at the concentrations of use.

The solvent compound of the stabilizing agent preferably comprises at least one compound selected from alcohols, glycols and polyglycols.

According to another variant of the invention, the solvent compound can also contain, as a mixture with the said alcohols, glycols and/or polyglycols, at least one adjuvant chosen from dimethylformamide and N-methylpyrrolidone.

The solvent compound can comprise polyesters, ketones, esters, low molecular weight condensates or organic groups which have good solubility in water and which are resistant to an acid environment.

The activating agent, which can also additionally be used independently of the stabilizing agents or solvent compounds mentioned above, comprises cyclic or aromatic amino components, imidazole and/or carboxyimidazole derivatives and/or aliphatic amines.

The compositions according to the invention can also contain at least one compound chosen from oxidation catalysts consisting of metals and wetting agents which are resistant to an acidic oxidizing environment.

The oxidation catalysts can comprise at least one metal belonging to the first, second, third or fourth group. These are present in a percentage varying from 2 to 20,000 ppm and preferably from 10 to 3,000 ppm.

The term group is understood to denote a group which corresponds to a family represented in the same column of the Periodic Table of the Elements.

Metals from group 3 have proved to be advantageous and good results have been obtained with aluminium.

According to another variant of the invention, the composition can also comprise at least one wetting agent which is stable in acidic oxidizing medium, that is to say an agent capable of modifying the surface tension of the solid-liquid interface in order to improve wetting of the metal components by the treatment bath. It is advisable that this wetting agent is selected from those which are chemically inert in the presence of an acidic and oxidizing aqueous solution and, in particular, aqueous acidic peroxide solutions.

Wetting agents capable of withstanding an acidic oxidizing environment consist of nonionic, anionic, amphoteric or cationic condensates or of fluorinated derivatives or of a mixture of these.. Good results have been obtained with fluorinated anionic surface-active agents and condensates of ethylene glycol with alkylphenols, and their mixtures.

The pickling bath made up in that way and having the stabilizing agent described above can operate from a pH equal to 2.5 and up to a pH of 0.0 but ordinarily it operates at a pH below 1.3.

The pickling bath can preferably operate at pH values equal to or less than 0.3.

The possible presence of metal concentrations greater than 10,000 ppm does not greatly reduce the stability of the pickling System insofar as the stabilizing composition contains inhibitors which deactivate the decomposition action of the metal ions.

On the other hand, other components of the stabilizing composition reduce the oxidation potential of iron/nickel/chromium suboxides and catalyze their oxidation, in that way favouring conversion to soluble oxides.

The presence in a pickling bath of the stabilizing composition which is the subject of the present invention makes it possible to carry out the pickling within time periods and at temperatures which are extremely competitive with respect to the baths which are currently used.

According to another variant of the composition according to the invention, it is also possible to incorporate therein adjuvants for the precipitation and, hence, for the deactivation of the dissolved metals arising from dissolution of the oxides or of the surface part of the metal component under the action of the treatment bath. Such adjuvants can be soluble inorganic or organic salts in which the anion combines with the cation of the dissolved metal(s) in the bath to form a salt whose solubility product is very low under the conditions prevailing in the bath, for example less than $10^{-5}$ gram ion.

The composition can additionally comprise at least one compound chosen from phosphates and phosphonares as coadjuvants for the precipitation and deactivation of the dissolved metals and inorganic and organic acids as agents for equalization of the treatment. The latter are used to make the product uniform.

Precipitation coadjuvants can be chosen from phosphates and phosphonates of any type. Pyrophosphates are well suited.

Finally, one or a number of inorganic and/or organic acids can also be added to the bath as agents which make it possible to obtain a uniform result over the whole surface of the metal component to be treated. Organic acids are preferred. Examples of such organic acids are picric acid and citric acid.

In reality, the pickling action obtained by means of the use of the composition which has high stabilizing properties and which is the subject of the present invention does not normally require any stirring of the baths or of the elements which are immersed therein.

Be that as it may, it is possible, in a highly acceptable way, to use ultrasound, which is normally used in combination with the pickling bath or preferably during the rinsing stages, in place of mechanical stirring and with the same aim as the latter, which makes it possible to obtain a synergy of the result.

The use of ultrasound makes it possible, in fact, to greatly reduce the duration of the pickling, as far as ⅙ of the time which would have been necessary in the absence of the use of ultrasound.

The invention thus also relates to processes for the treatment of metal surfaces, more particularly of surfaces of stainless steels, in the presence of the stabilizing compositions described above by means of at least one inorganic peroxide at acid pH. This treatment is then followed by at least one rinsing. During at least one of the treatment or rinsing stages, agitation of the bath can be obtained using ultrasound.

In the process according to the invention, it is possible to use variable doses of the various active compounds and especially of acid, inorganic peroxides and stabilizing composition according to the invention. It is thus possible to use from 0.1 to 5 mol and preferably from 0.5 to 3 mol of peroxidized compound per litre of solution. The amount of acid is added to maintain the pH at the desired values. Report may be made, among acids which may be used for this purpose, of sulphuric acid, which is particularly well suited. It can be used in combination with fluorides and, for example, with hydrofluoric acid in variable ratios. In this case, the sulphuric acid/hydrofluoric acid ratios by weight do not generally exceed 500 and, most often, not 100. Likewise, these ratios are not generally less than 0.1 and, most often, not less than 1.

The invention also relates to the use of the composition described above for the production of a bath for pickling, passivating, polishing and/or burnishing metals.

EXAMPLE

By way of illustration, the following example is reported of a typical composition of a pickling bath for steels such as austenitic steels. This example is not intended to limit the scope of the invention in any way.

EXAMPLE

| | |
|---|---|
| 98% sulphuric acid | from 4 to 300 g/l |
| 100% hydrogen peroxide | from 0.2 to 100 g/l |
| hydrofluoric acid | from 0.5 to 10 g/l |
| stabilizing composition | from 0.2 to 30 g/l |
| where the typical stabilizing composition consists of: | |
| p-toluenesulphonic acid | 10 |
| N-methylpyrrolidone | 22 |
| ethylene glycol | 5 |
| benzotriazole + imidazole (approximately 50%/50%) | 3 |
| aluminium$^{+++}$ | 3 |
| fluorinated anionic surface- | 0.5 |

-continued

| | |
|---|---|
| active agent (FC ® 95: registered trade mark of the company 3M) | |
| condensate of ethylene oxide and of octylphenol | 5 |
| pyrophosphate ion | 4 |
| sulphuric acid | 10 |
| citric acid | 2 |
| water make up to | 100 |

Comparative tests were carried out on annealed pipes made of AISI 304 steel and treated in the following way:

1 - conventional mixture containing 180 g/l of nitric acid and 30 g/l of hydrofluoric acid as well as wetting agents (3 g/l ). This solution was used for 45 minutes at 30° C.

2 - mixture containing 180 g/l of sulphuric acid, 40 g/l of $H_2O_2$ and 30 g/l of hydrofluoric acid. Same conditions as in Case 1.

3 - mixture similar to Mixture 2 but addition of the typical stabilizing composition at a concentration of 5 g/l and prepared as shown.

4 - mixture similar to Mixture 2 with addition of the stabilizing composition at a concentration of 1 g/l.

5 - mixture similar to Mixture 2 with addition of the stabilizing composition at a concentration of 10 g/1.

The results obtained are the following:

Pickling

Test 1=by comparison

Test 2=incomplete

Test 3=result similar to Test 1 after a time of 35 minutes.

Test 4=result similar to Test 1 after a time of 45 minutes.

Test 5=result similar to Test after a time of 30 minutes.

$H_2O_2$ weight loss

Test 2=24 hours after the test, there remains 28 g of $H_2O_2$ per 1.

Test 3=24 hours after the test, there remains 32 g of $H_2O_2$ per 1.

Test 4=24 hours after the test, there remains 28 g of $H_2O_2$ per 1.

Test 5=24 hours after the test, there remains 33 g of $H_2O_2$ per 1.

The same test, repeated after 96 hours, shows the following values:

Test 2=2 g of $H_2O_2$ per 1.

Test 3=28 g of $H_2O_2$ per 1.

Test 4=20 g of $H_2O_2$ per 1.

Test 5=31 g of $H_2O_2$ per 1.

Stability tests were then carried out by incorporating in the mixture, consisting of 180 g/l of sulphuric acid, 40 g/l of $H_2O_2$ and 30 g/l of hydrofluoric acid, an amount of 8 g/l of AISI 304 steel and by then relating the $H_2O_2$ content to the starting values.

The typical stabilizing composition was added to the solution obtained in the following amounts:

Test 6=1 g/l

Test 7=5 g/l

Test 8=10 g/l

These different solutions were maintained at a temperature of 25° C. and at 50° C. for 48 hours. By doing this, the following results were obtained:

Test 6=34 g/l and 24 g/l of $H_2O_2$

Test 7=37 g/l and 32 g/l of $H_2O_2$

Test 8=38 g/l and 35 g/l of $H_2O_2$

It emerges from the tests carried out that the typical stabilizing composition makes it possible to prevent the decomposition of hydrogen peroxide, even when hot.

It could be observed in practice that the composition of the invention, which has high stabilizing properties and more particularly in the case of inorganic peroxides used in the context of industrial applications, had many advantages of all kinds.

For example, the temperatures of use of the pickling baths prove to be equal to or effectively less than the temperatures which are those of the baths based on nitric and hydrofluoric acid and therefore highly polluting.

By using the composition having significant stabilizing properties which is the subject of the present invention in a bath, no emission of nitrous vapours is observed and the emission of acids, for example fluorides, is, for its part, greatly reduced.

It is possible, in the case of baths which resort to the new composition which is the subject of the present invention, to use the same equipment as that which is used in the case of nitric/hydrofluoric mixtures, without it, however, being necessary to carry out significant modifications of these plants.

Inter alia, the removal of intergranular corrosions is also obtained and the process can be adapted to various types of stainless steels such as, for example, steels of the AISI 400 series (pickling of which is generally carried out with some difficulty with the traditional systems) or alternatively steels of the AISI 300 series. It is well understood that the compositions according to the invention are equally well suited to the treatment of other types of stainless steels.

It is also important to recall that the use of the stabilizing composition described above makes it possible in particular to greatly reduce the consumption of inorganic peroxide, more particularly of hydrogen peroxide, while making possible pickling times equal to or effectively less than, even as far as 50%, with respect to the pickling times necessary in the case of the traditional baths.

In addition to these various advantages, it is further observed that the result gives a surface with a silvery-white colour, without a trace of dust.

In the case where it would be additionally desired to subsequently accelerate the pickling process, it is possible—as has been explained and as claimed—to also use an ultrasound system during the pickling and/or rinsing stages, so as greatly to reduce the time periods for these two operations.

The perfected invention is capable of many modifications and variants, which are all encompassed by the present inventive concept. All the details can additionally be replaced by technically equivalent elements.

What is claimed is:

1. A stabilizing composition for an inorganic peroxide, comprising:

at least one activating agent selected from benzotriazoles, imidazole, and carboxyimidazoles or their derivatives, at least one stabilizing agent, and at least one solvent for said stabilizing agent selected from the group consisting of glycols and polyglycols.

2. The composition according to claim 1, including at least one wetting agent which is stable in acidic oxidizing medium.

3. The composition according to claim 1, wherein the stabilizing agent comprises at least one compound selected from mono- or polycyclic alicyclic or aromatic compounds and aliphatic compounds substituted by at least one group chosen from sulphonate, ester, diene, and mercaptoazole groups.

4. The composition according to claim 1, wherein the solvent includes N-methylpyrrolidone.

5. The composition according to claim 1, including at least one compound chosen from phosphates and phosphonates as coadjuvants for the precipitation and deactivation of dissolved metals.

6. In a bath for pickling, polishing or burnishing metals, the improvement comprising a composition according to claim 1.

7. In a process for the treatment of metal surfaces, the improvement comprising a treatment with at least one inorganic peroxide at an acid pH in the presence of the compositions according to claim 1.

8. The process according to claim 7, including at least one rinsing carried out after the treatment with inorganic peroxide.

9. The process according to claim 7, including during at least one of the treatment with inorganic peroxide or rinsing stages, agitation of the bath using ultrasound.

10. The composition according to claim 1, wherein said activating agent comprises a benzotriazole or derivative thereof.

11. The composition according to claim 1, wherein said activating agent comprises an imidazole or derivative thereof.

12. The composition according to claim 1, wherein said activating agent comprises a carboxyimidazole or derivative thereof.

13. The composition according to claim 1, including at least one inorganic or organic acid for equalization of treatment.

14. The composition according to claim 5, wherein said coadjuvant is a pyrophosphate.

15. A stabilizing composition for an inorganic peroxide, comprising:

at least one activating agent selected from benzotriazoles, imidazole, and carboxyimidazoles or their derivatives, and an oxidation catalyst comprising at least one metal belonging to Groups I to IV of the Periodic Table.

16. A stabilizing composition for an inorganic peroxide, comprising:

at least one activating agent is selected from a carboxyimidazole or derivative thereof, and at least one stabilizing agent and at least one solvent for said stabilizing agent.

* * * * *